United States Patent [19]

Gorter

[11] 4,336,650

[45] Jun. 29, 1982

[54] CUTTING UNIT FOR A SHAVING APPARATUS

[75] Inventor: Willem K. Gorter, Eindhoven, Netherlands

[73] Assignee: U.S. Philips Corporation, New York, N.Y.

[21] Appl. No.: 207,322

[22] Filed: Nov. 17, 1980

[30] Foreign Application Priority Data

Dec. 17, 1979 [NL] Netherlands ..... 7909059

[51] Int. Cl.[3] ..... B26B 19/42

[52] U.S. Cl. ..... 30/34.2; 30/43.6

[58] Field of Search ..... 30/34.2, 43.6

[56] References Cited

U.S. PATENT DOCUMENTS

| | | | |
|---|---|---|---|
| 3,834,017 | 9/1974 | Tolmie | 30/34.2 |
| 3,871,073 | 3/1975 | Nissen | 30/34.2 |
| 4,258,470 | 3/1981 | Boiten | 30/34.2 |
| 4,272,884 | 6/1981 | Tietjens | 30/43.6 |
| 4,275,497 | 6/1981 | Engelhardt | 30/34.2 |

FOREIGN PATENT DOCUMENTS

| | | | |
|---|---|---|---|
| 6661 | 1/1980 | European Pat. Off. | 30/43.6 |

*Primary Examiner*—Jimmy C. Peters

*Attorney, Agent, or Firm*—Thomas A. Briody; William J. Streeter; Rolf E. Schneider

[57] ABSTRACT

There is provided a shaving apparatus having a circular shear plate and a cutting unit rotatable relative to the shear plate. The cutting unit comprises a cutting member having cutters extending toward the shear plate and a lead-cutting element having lead cutters extending toward the shear plate and respectively associated with and movable relative to the cutters away from and toward the shear plate. Each lead cutter, with reference to the direction of rotation of the cutting unit, is positioned in front of its associated cutter. A spacer is interposed between each cutter and its associated lead cutter.

7 Claims, 9 Drawing Figures

CUTTING UNIT FOR A SHAVING APPARATUS

Figure 1:
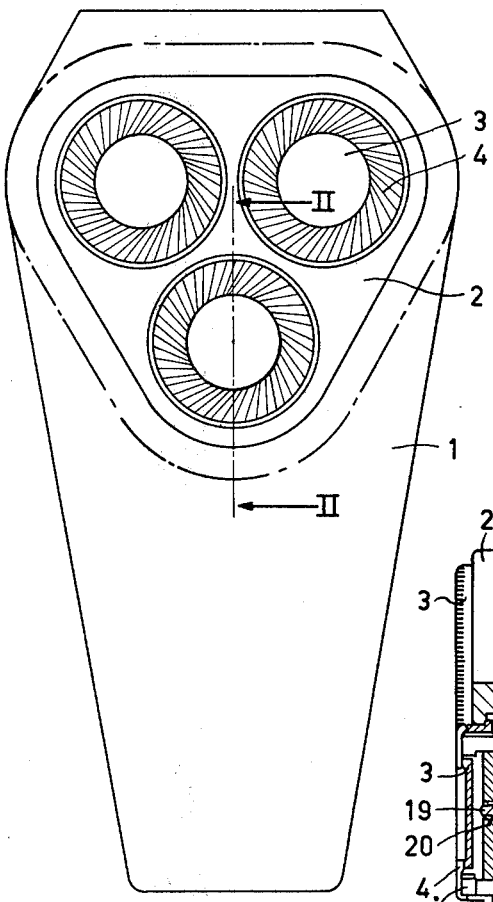

This invention relates to a cutting unit for a shaving apparatus, more particularly a cutting unit comprising at least one cutter and an associated hair-pulling blade or lead cutter which is mounted so as to be movable relative to the cutter in directions away from and towards the user's skin in a position adjacent and ahead of the cutter when the cutting unit is in use on a shaving apparatus.

Such a cutting unit is known from U.S. Pat. No. 3,962,784. In the operation of the cutting unit, as the shaving apparatus is moved over the user's skin the hair-pulling blade engages hairs immediately ahead of the cutter. The hair-pulling blade is moved away from the skin by the reaction from these hairs and in this movement pulls the hairs partially out of the skin while the cutter approaches and severs the hairs. Resilient means urges the hair-pulling blade back towards the skin. The action of the hair-pulling blade results in a closer shave than is obtainable without the use of a hair-pulling blade. The movement of the hair-pulling blade between the instant at which the blade meets a hair and the instant at which the hair is severed by the cutter is limited by, inter alia, the shape and the dimensions of the hair-pulling blade.

According to the present invention there is provided a cutting unit for a shaving apparatus, the cutting unit comprising at least one cutter and an associated hair-pulling blade lead cutter which is mounted so as to be movable relative to the cutter in directions away from and towards the user's skin in a position adjacent and ahead of the cutter when the cutting unit is in use on a shaving apparatus, wherein a spacer is interposed between the cutter and the hair-pulling blade.

The invention is very suitable for application to a cutting unit for a dry-shaving apparatus of the kind (hereinafter referred to as "the kind described") having a shear plate or foil with hair-entry apertures and a cutting unit which is movable relative to and cooperates with the shear plate or foil and which comprises a plurality of cutters and a plurality of hair-pulling blades or lead cutter each of which is disposed adjacent and in front of an associated one of the cutters with respect to the direction of the cutting movement thereof and is movable relative thereto in directions away from and towards the shear plate or foil and each of which has a sharp edge which, as the hair pulling blade moves over a hair-entry aperture of the shear plate or foil in front of the associated cutter when the cutting unit is in operation in a shaving apparatus, penetrates hairs protruding through that aperture and, by movement of the hair-pulling blade relative to the cutter under the reaction from the hairs, moves away from the shear plate or foil and pulls the hairs further through the aperture while the cutter approaches and severs the hairs.

Accordingly, the present invention provides a cutting unit for a dry-shaving apparatus of the kind described, the cutting unit comprising a plurality of cutters and a plurality of hair-pulling blades or lead cutters each of which is disposed adjacent and in front of an associated one of the cutters with respect to the direction of the cutting movement thereof and is supported so as to be movable relative to the associated cutter in directions away from and towards the shear plate or foil when the cutting unit is mounted in a dry-shaving apparatus, wherein a spacer is interposed between each cutter and its associated hair-pulling blade.

The or each spacer may be free to move relative to the cutter or associated cutter, and the or each hair-pulling blade may be free to move relative to the spacer or associated spacer.

Alternatively, the or each spacer may be connected to the cutter or the hair-pulling blade or to the associated cutter or the associated hair-pulling blade.

In a cutting unit according to the invention for a dry-shaving apparatus of the kind described, and which cutting unit is constructed for rotary motion, the spacers may form part of a spacing element comprising a central portion to which the spacers are connected by arms, the central portion, arms and spacers being formed integrally with one another.

The central portion of this spacing element may be formed with a coupling aperture for coupling the cutting unit to a drive mechanism of a dry-shaving apparatus, and may also comprise means for connecting together the components of the cutting unit.

The invention further provides a shaving apparatus having a cutting unit according to the invention. The shaving apparatus may be a dry-shaving apparatus of the kind described.

Figure 2:
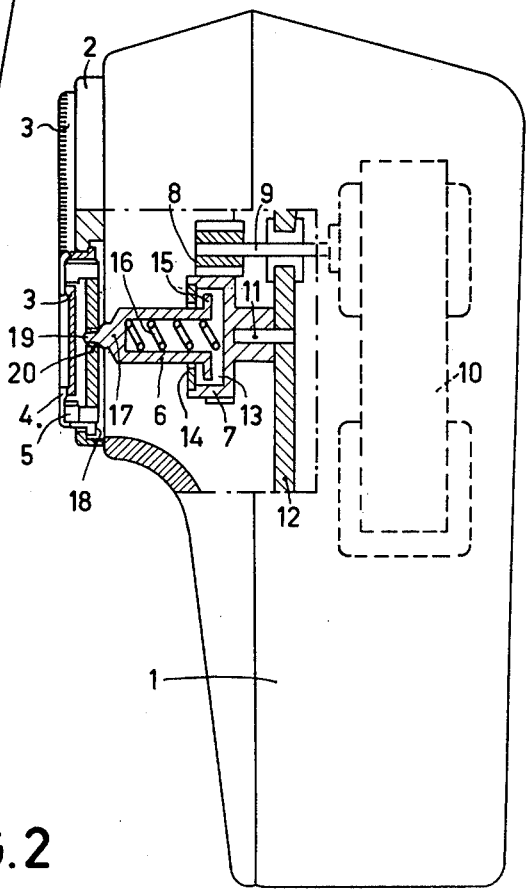
Figure 3:
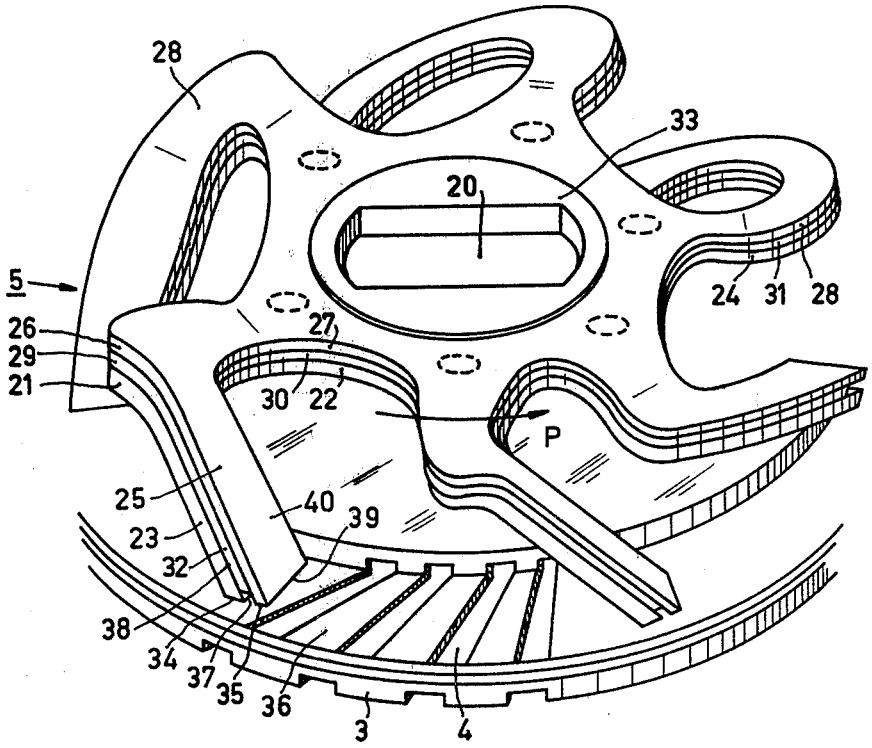
Figure 4:
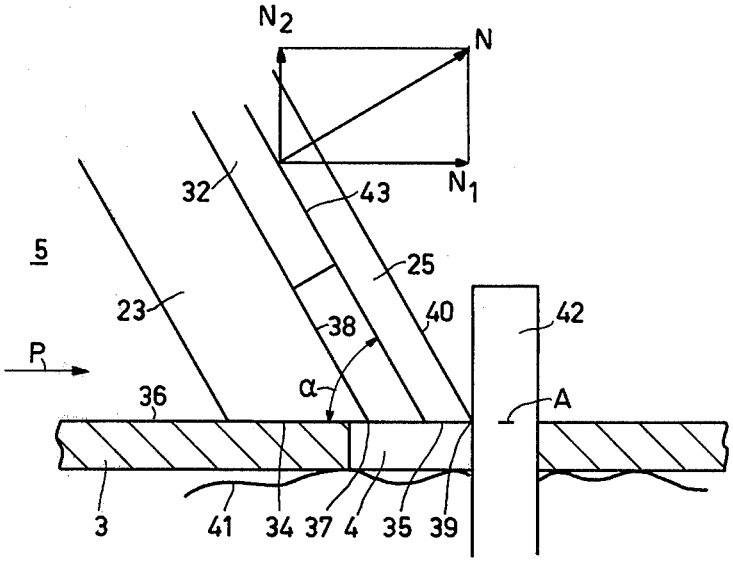
Figure 5:
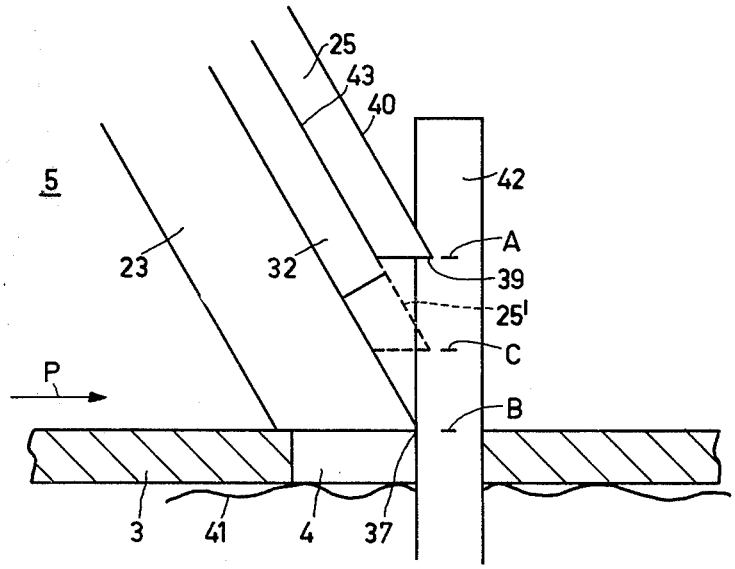

The invention will now be described with reference to the accompanying drawings, in which:

FIG. 1 is a front elevation of a dry-shaving apparatus of the kind described with three cutting units and associated shear plates, FIG. 2 is a side elevation of the shaving apparatus of FIG. 1, showing a shear plate and a cutting unit and an associated driving means in section, the section being taken on the line II—II in FIG. 1, FIG. 3 is a perspective view drawn on an enlarged scale, of an embodiment of a cutting unit according to the invention for the shaving apparatus of FIGS. 1 and 2, together with a portion of the associated shear plate, FIGS. 4 and 5 are diagrammatic side views, drawn on an even larger scale, of a cutter and an associated hair-pulling blade of the cutting unit shown in FIG. 3, and a portion of the associated shear plate, illustrating the operation of the hair-pulling blade.

Figure 6:
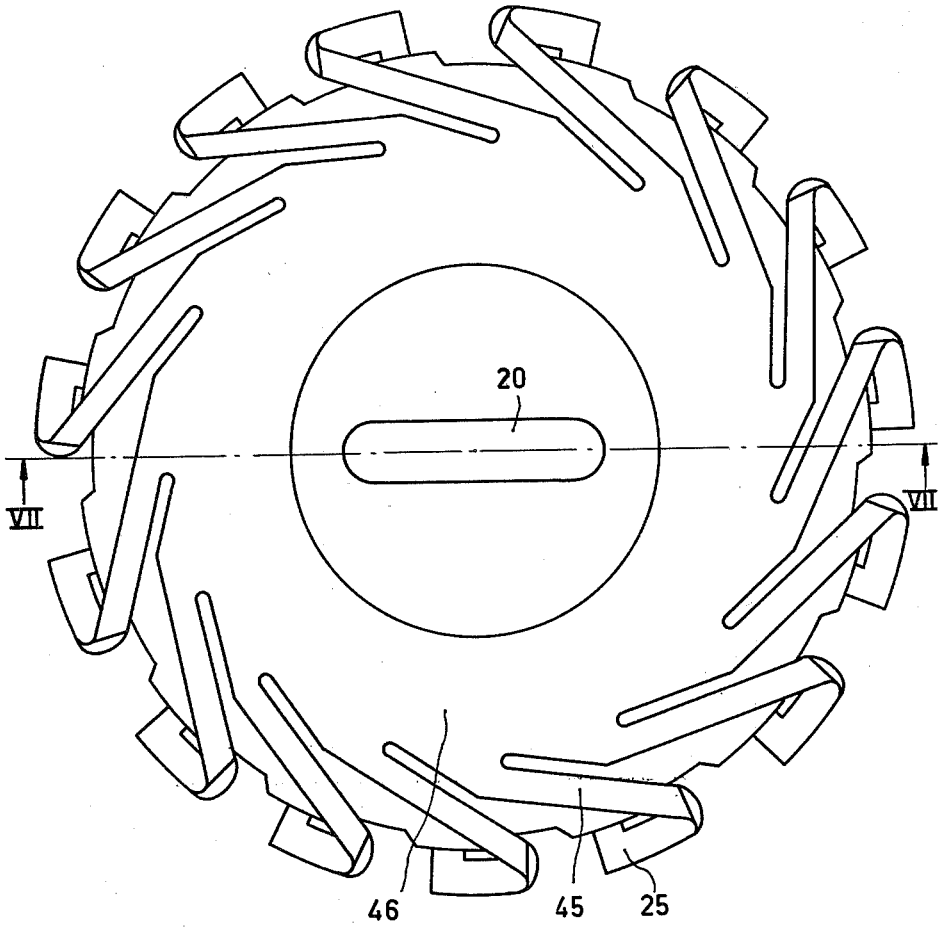
Figure 7:
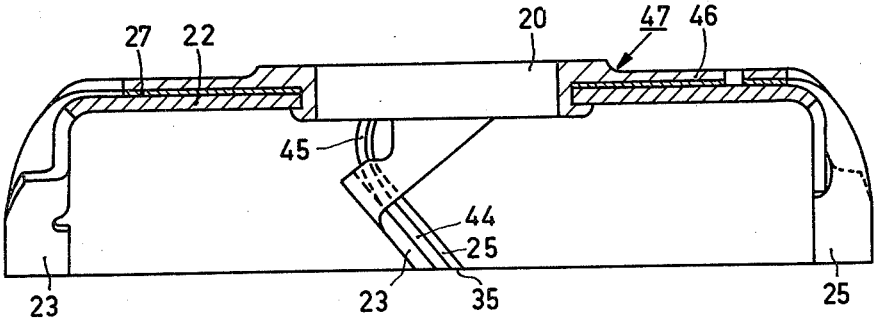
Figure 8:
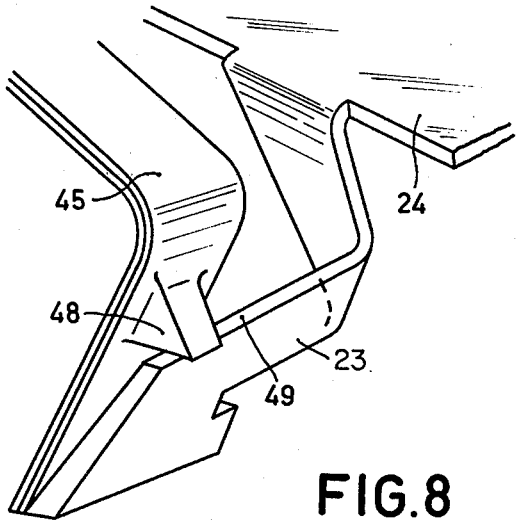
Figure 9:
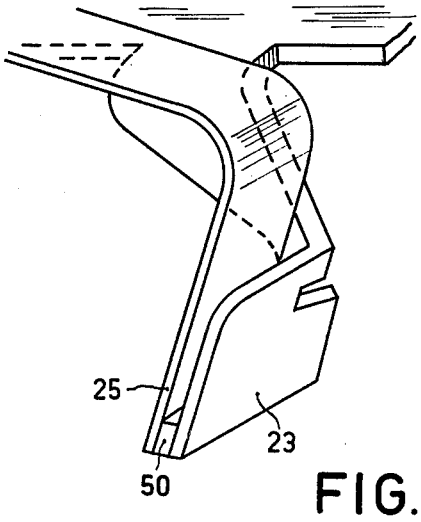

FIG. 6 shows on an enlarged scale another embodiment of the cutting unit,

FIG. 7 shows the cutting unit of FIG. 6 in a sectional view taken on the line VII—VII in FIG. 6, FIG. 8 is a fragmentary perspective view, drawn on a greatly enlarged scale, of a cutter and a hair-pulling blade, with an interposed spacer, of a cutting unit according to a further embodiment of the invention, and FIG. 9 is a view similar to FIG. 8, showing yet another embodiment of a cutting unit according to the invention.

The shaving apparatus of FIGS. 1 and 2 comprises a housing 1, on which is mounted a shear-plate holder 2 for three stationary shear plates 3. The shear plates 3 are of circular form and each has a circular pattern of hair-entry apertures in the form of slots 4.

A rotary cutting unit 5 (FIG. 2) is disposed at the inner side of each shear plate 3 for cooperation therewith. The cutting units 5, of which one is shown schematically in FIG. 2 are rotated relative to the respective shear plates 3 by an electric motor 10 to which each cutting unit is coupled by an associated hollow spindle 6, a gear wheel 7 and a gear wheel 8 fixed on the spindle 9 of the electric motor 10. The gear wheel 7 is rotatably journalled on an associated pin 11, which is fixed in a mounting plate 12. The gear wheel 7 is formed with a recess 13 which is covered by a cover plate 14. This recess accommodates a flange 15 formed at the end of the hollow spindle 6. The flange 15 has a non-circular, for example square, shape and the recess 13 is correspondingly shaped so that a coupling is obtained for transmitting the rotary movement of the gear wheel 7 to the spindle 6, the spindle being tiltable in all directions. A coil spring 16, which for its greater part is situated within the hollow spindle 6 and an end wall of the recess 13 in the gear wheel 7, exerts a force on the spindle 6 in the direction of the cutting unit 5. A conical portion 17 of the spindle 6 bears against the cutting unit 5 to transmit this force to the cutting unit and via the cutting unit to the shear plate 3, so that the flange 18 around the periphery of the shear plate is urged against the shear plate holder 2. During use of the shaving apparatus, the shear plates 3, together with the associated cutting units 5 and spindles 6, can be pressed inwards against the action of the springs 16 under the pressure with which the shear plates are held against the user's skin.

A coupling for the transmission of the rotary movement of each spindle 6 to the associated cutting unit 5 is formed by an end portion 19 of the spindle of substantially rectangular cross-section engaging in a central coupling aperture 20 of corresponding shape in the cutting unit 5.

All three cutting units of the apparatus of FIGS. 1 and 2 are coupled to the motor 10 in the above manner, the three gear wheels 7 meshing with the single centrally arranged gear wheel 8 on the motor spindle 9.

As shown in FIG. 3, each cutting unit 5 comprises a cutting element or member 21, which is manufactured as a single component from metal sheet and which consists of a central body or portion 22 which is provided around its periphery with cutters 23 which are rigidly connected to the central portion 22 by arms 24. As shown in FIGS. 4 and 5, each cutter 23 has at its front (with respect to the direction of movement P of the cutting unit) a sloping face 38 which forms an acute angle $\alpha$ with the end face 34 of the cutter which is in sliding contact with the inner surface 36 of the respective shear plate 3. The edge 37 at which the faces 38 and 34 meet is the cutting edge of the cutter. In the operation of the shaving apparatus the end face 34 of each cutter 23 travels over the hair-entry apertures or slots 4 in the respective shear plate and the cutting edge 37 of the cutter, in cooperation with the shear plate at the boundaries of the slots, severs the hairs which protrude through the slots.

Each cutting unit 5 also comprises a plurality of hair-pulling blades or lead cutters 25 disposed one in front of each cutter 23. Each hair-pulling blade 25 has an end face 35 which is arranged for sliding contact with the inner surface 36 of the respective shear plate 3 in front of the end face 34 of the associated cutter 23. The edge 39 of each hair-pulling blade at which the end face 35 of the blade meets the front face 40 thereof is the leading edge of the hair-pulling blade in the movement of the blade over the shear plate, the two faces forming an acute angle at this edge.

In the embodiment shown in FIG. 3 the hair-pulling blades 25 are distributed around the periphery of the central portion 27 of a hair-pulling or lead cutting element 26 of similar shape to the cutting element 21, the hair-pulling blades 25 being connected to the central portion 27 by arms 28. The hair-pulling element 26 also is made as a single component from metal sheet, in this case elastic metal sheet so that the connecting arms 28 are resilient.

Between the cutting element 21 and the hair-pulling element 26 of each cutting unit there is interposed a correspondingly shaped spacing element 29 comprising spacers 32 which are interposed one between each cutter 23 and its associated hair-pulling blade 25 and which are respectively connected by arms 31 to a central section or portion 30 of the spacing element. This spacing element is preferably made of a plastic. The central portion 30 of the spacing element 29 is provided with a short hub 33 which projets from both sides of the spacing element and on which the cutting element 21 and the hair-pulling element 26 are centred. The hub 33 is formed with the coupling aperture 20, and the cutting and hair-pulling elements 21 and 26 are formed with central apertures to fit on the hub 33. The three elements 21, 26 and 29 of the cutting unit 5 may be secured to each other by softening the ends of the hub 33 with heat and flanging these softened ends over the edges of the elements 21 and 26 surrounding the central apertures therein. Alternatively, the elements 21, 26 and 29 may be interconnected by glueing or, in the case of metal elements, by spot-welding.

As already explained with reference to FIGS. 1 and 2, each cutting unit 5 is spring-loaded, so that the end faces 34 of the cutters 23 and the end faces 35 of the hair-pulling blades 25 of the unit bear on the inner surface 36 of the associated shear plate 3. Owing to the elasticity of the connecting arms 28 the hair-pulling blades 25 are movable relative to the associated cutters 23 and the spacers 32 in directions away from and towards the shear plate 3. In this movement the hair-pulling blades 25 slide on the front faces 43 (FIGS. 4 and 5) of the respective spacers 32.

FIGS. 4 and 5 illustrate the operation of a hair-pulling blade 25 and its associated cutter 23, a portion of the user's skin being shown at 41, with a hair 42 also being shown, caught in a hair-entry aperture 4. When the hair is caught in the aperture 4 the rotary movement of the cutting unit 5 in the direction of the arrow P relative to the shear plate 3 will bring the sharp leading edge 39 of the hair-pulling blade 25 into contact with the hair at the location A thereof (FIG. 4). The edge 39 has a sharpness such that it will slightly penetrate the hair without severing it. A reactive force is exerted on the hair-pulling blade 25 by the hair 42 in a direction opposite to the direction of movement P of the blade. This force is counteracted by the component $N_1$ of the normal force N (FIG. 4) which is exerted on the hair-pulling blade 25 by the front face 43 of the associated spacer 32. For the sake of simplicity the small frictional forces which occur between the spacer 32 and the hair-pulling blade 25 are ignored. The component $N_2$ of the normal force N will cause the hair-pulling blade 25 to slide up the front face 43 of the spacer 32. As the hair-pulling blade 25 is simultaneously moving in the direction P the resulting movement of the hair-pulling blade relative to the shear plate 3 will be substantially in the direction of the force component $N_2$ and thus substantially perpendicular to the shear plate and in the inward direction.

Owing to, inter alia, the natural elasticity of the skin, the hair will be pulled up from the skin by the hair-pulling blade 25 until the cutting edge 37 of the cutter 23 has reached the hair at the location B thereof (FIG. 5). Thus, the hair 42 is pulled inwards by the hair-pulling blade 25 through the distance from A to B before being severed at B by the cutter 23 in co-operation with the shear plate 3. Owing to the elasticity of the arm 28 (FIG. 3) with which the hair-pulling blade 25 is connected to the central portion 27 of the hair-pulling element 26, the hair-pulling blade is immediately returned to the initial position shown in FIG. 4 after the hair has been severed.

Without the hair-pulling blade 25 the hair 42 would have been severed at the location A. Thus, with a shaving apparatus having a cutting unit with hair-pulling blades the length of hair left in the skin is shorter by an amount equal to the distance AB than with an apparatus which does not have hair-pulling blades.

For comparison FIG. 5 also shows a hair pulling blade 25', represented by broken lines, which without a spacer 32 directly engages the associated cutter 23. This hair-pulling blade 25', which acts on the hair 42 at the location C, can pull up the hair only through a distance corresponding to the distance BC before the hair is severed. Thus, by the use of the spacer 32 the distance AC is gained in pulling up the hair, so that the efficiency of the hair-pulling blades is increased accordingly.

The use of the spacers 32 instead of thicker hair-pulling blades has the advantage that it does not increase the mass of the hair-pulling element or reduce the resilience of the connecting arms 28 of this element.

Although for the sake of simplicity the friction between the hair-pulling blades and the spacers has been ignored, such friction does occur in practice. Preferably a material is selected for the spacers which provides an optimum friction coefficient between the spacers and the hair-pulling blades.

In order to obtain an inwardly directed component $N_2$ of the reactive force N between each spacer 32 and associated hair-pulling blade 25, the angle between the plane containing the front face 43 of the spacer and the inner surface 36 of the respective shear plate 3 which angle is equal to the angle $\alpha$ in the embodiment shown, should be smaller than 90°.

The leading edges 39 of the hair-pulling blades 25 may in principle have the same sharpness as the cutting edges 37 of the cutters 23. Since the hair-pulling blades yield under the reaction from the hairs the edges 39 will only slightly penetrate the hairs and will not sever them.

In the case of the operation as described with reference to FIGS. 4 and 5 the spacers do not move relative to the cutters. Each spacer 32 may, for example, be secured directly to the associated cutter 23. It is also possible to have an embodiment in which each spacer 32 is movable along the front face 38 of the associated cutter 23. The spacer 32 can then follow either part or the whole of the movement of the associated hair-pulling blade 25 under the influences of the frictional forces between the spacer and the hair-pulling blade. The arms 31 by which the spacers 32 are connected to the central portion 30 of the spacing element 29 should then be sufficiently elastic to allow this movement of the spacers.

The cutting unit of FIGS. 6 and 7 differs slightly from that described above. Corresponding parts of the cutting and hair-pulling elements of the two embodiments bear the same reference numerals. Between the cutters 23 and the hair-pulling blades 25 spacers 44 are interposed, which spacers are connected by arms 45 to a central portion 46 of a spacing element 47. This element, comprising the parts 44, 45, 46, is preferably manufactured as a single component from a plastic. The central portion 27 of the hair-pulling element is located between the central portion 22 of the cutting element and the central portion 46 of the spacing element 47. The central portion 46 is again formed with a coupling aperture 20 and also serves to connect the cutting element and the hair-pulling element. Each sensor 44 may extend up to the end face 35 of the associated hair-pulling blade 25, so that the hair-pulling blade derives greater support from the associated cutter 23 via the spacer. In the embodiment shown in FIGS. 3 to 5 each spacer terminates at some distance from the cutting edge 37 of the associated cutter 23 so that it does not obstruct the operation of the cutter. The spacers 44 may be rigidly connected to the hair-pulling blades 25, for example by glueing.

The connecting arms 45 of the spacing element 47 may be provided with projections 48 (FIG. 8) for engagement with the respective upper sides 49 of the cutters 23 to ensure that the hair-pulling blades and the spacers cannot possibly enter a hair-entry aperture 4 in the shear plate 3. Also, the hair-pulling blades are more accurately positioned relative to the cutters by means of the projections 48.

Although it is advantageous for manufacturing reasons to construct the spacers as integral parts of a single spacing element 29 or 47 having a central portion and arms connecting the spacers to the central portion, the connecting arms 31, 45 and the central portions 30, 46 may be dispensed with and the spacers 32, 44 secured directly to the associated cutters 23 or the hair-pulling blades 25. FIG. 9 shows an embodiment in which individual spacers 50 are secured to the hair-pulling blades 25. Each spacer may be manufactured as a separate component, for example from a plastic, and be subsequently secured to the associated hair-pulling blade, for example by glueing. It is also possible to manufacture each hair-pulling blade 25 and the associated spacer integrally, for example by means of etching techniques.

The invention is not limited in its application to a rotary cutting unit for a dry-shaving apparatus; it can also be applied to a reciprocatory cutting unit, for example. Furthermore, it is not limited to a cutting unit for a dry-shaving apparatus; a shaving apparatus for use in wet shaving, for example, a safety razor, in which there is no shear plate or foil and the cutting unit is in direct contact with the user's skin, as in the razor described in U.S. Pat. No. 4,044,463 can have a cutting unit constructed in accordance with the present invention.

What is claimed is:

1. A shaving apparatus having a circular shear plate provided with hair-entrance apertures and a cutting unit associated with and rotatable relative to the shear plate; said cutting unit comprising a cutting member having a circular central body, cutters extending from the circumference of said central body toward the shear plate, a lead-cutting element having a circular central portion, lead cutters extending from the circumference of said central portion toward the shear plate and respectively associated with and movable relative to the cutters away from and toward the shear plate, each lead cutter, with reference to the direction of rotation of the cutting unit, being positioned in front of its associated cutter, and a spacer interposed between each cutter and its associated lead cutter.

2. A shaving apparatus according to claim 1, in which each spacer terminates short of the corresponding ends of its associated cutter and lead cutter.

3. A shaving apparatus according to claim 1, in which each spacer extends to the corresponding ends of its associated cutter and lead cutter.

4. A shaving apparatus according to claim 2 or 3, in which each spacer is movable relative to its associated cutter, the associated lead cutter being movable relative to said spacer.

5. A shaving apparatus according to claim 2 or 3, in which each spacer is secured to its associated cutter, the associated lead cutter being movable relative to said spacer.

6. A shaving apparatus according to claim 2 or 3, in which each spacer is secured to its associated lead cutter, said spacer being movable relative to the associated cutter.

7. A shaving apparatus according to claim 2 or 3, which includes a spacing element having a circular central section, the spacers extending from the circumference of said central section toward the shear plate, said spacing element being interposed between the cutting member and the lead-cutting element.

* * * * *